US005115603A

United States Patent [19]

Blair

[11] Patent Number: 5,115,603

[45] Date of Patent: May 26, 1992

[54] ROOF VALLEY FLASHING INCLUDING EXPANSION JOINT

[75] Inventor: Earl Blair, San Marino, Calif.

[73] Assignee: Roof-Flex, Harbor City, Calif.

[21] Appl. No.: 585,431

[22] Filed: Sep. 20, 1990

[51] Int. Cl.[5] ..... E04D 13/04; E04D 1/36

[52] U.S. Cl. ..... 52/13; 52/11; 52/58; 52/60

[58] Field of Search ..... 51/11, 13, 14, 58, 60, 51/97, 396, 15

[56] References Cited

U.S. PATENT DOCUMENTS

| | | | |
|---|---|---|---|
| 373,129 | 11/1887 | Carroll | 52/13 |
| 2,133,683 | 10/1938 | Black | 52/13 |
| 2,258,078 | 10/1941 | Tennison | 52/13 |
| 3,264,790 | 8/1966 | Beals | 52/14 |
| 3,352,649 | 11/1967 | Tennison, Jr. | 52/13 |
| 3,411,259 | 11/1968 | Anderson et al. | 52/14 |
| 4,449,333 | 5/1984 | Stratton | 52/13 |

FOREIGN PATENT DOCUMENTS

| | | | |
|---|---|---|---|
| 483378 | 10/1929 | Austria | 52/13 |

*Primary Examiner*—Michael Safavi
*Attorney, Agent, or Firm*—Wagner & Middlebrook

[57] ABSTRACT

A roof valley structure including a unitary panel of durable polypropylene-rubber material having a longitudinal flexure section including a large fold through its center, interlocking ridges spared on each side of the flexure section, and a plurality of spaced parallel longitudinal ribs on the outside of each interlocking ridge. The ribs, folds and ridges are reduced in size slightly at one end of each panel to permit one panel to overlie and interlock with a panel lower on the roof valley. Another embodiment connects two or more such panels together by means of a horizontal fold thereby making it possible to fold the panels together for packing and shipping. The folds in the flexure sections of adjacent panels are designed to nest together when the two panels are folded. Special nailing sections are shown which compensate for thermal expansion and contraction.

17 Claims, 3 Drawing Sheets

FIG. 4
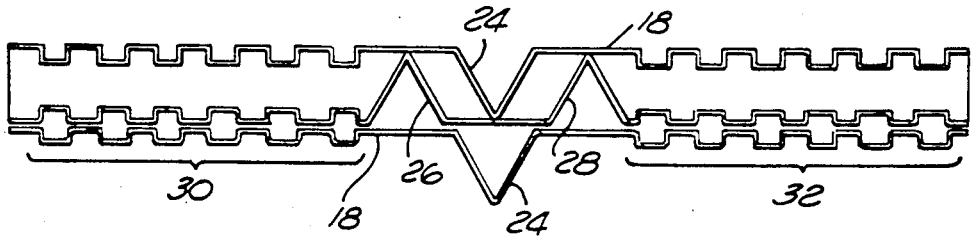
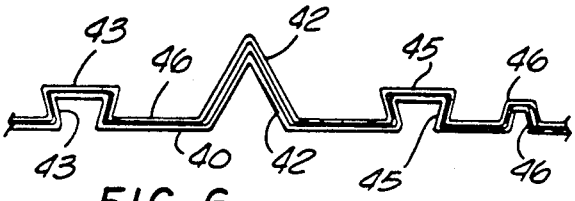
FIG. 6
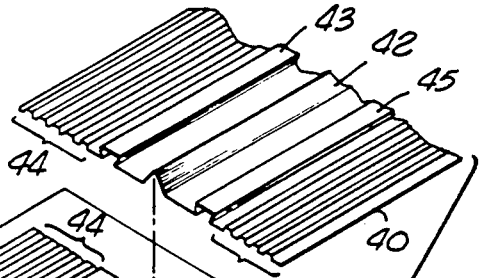
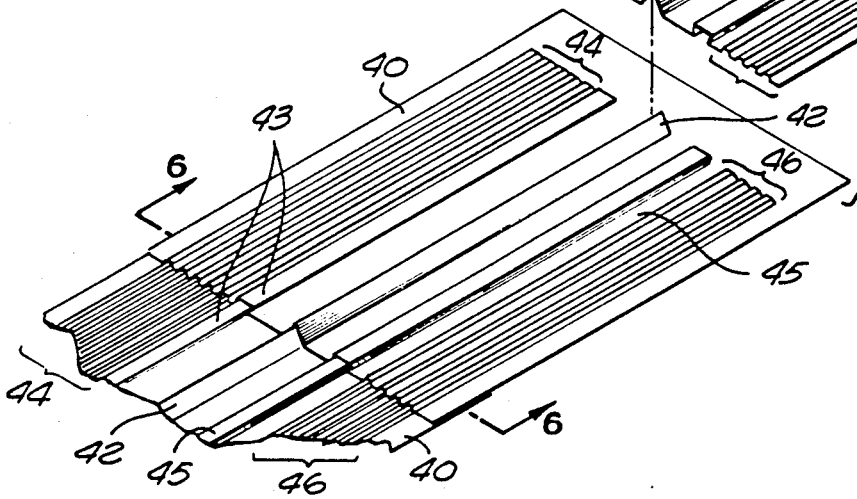
FIG. 5
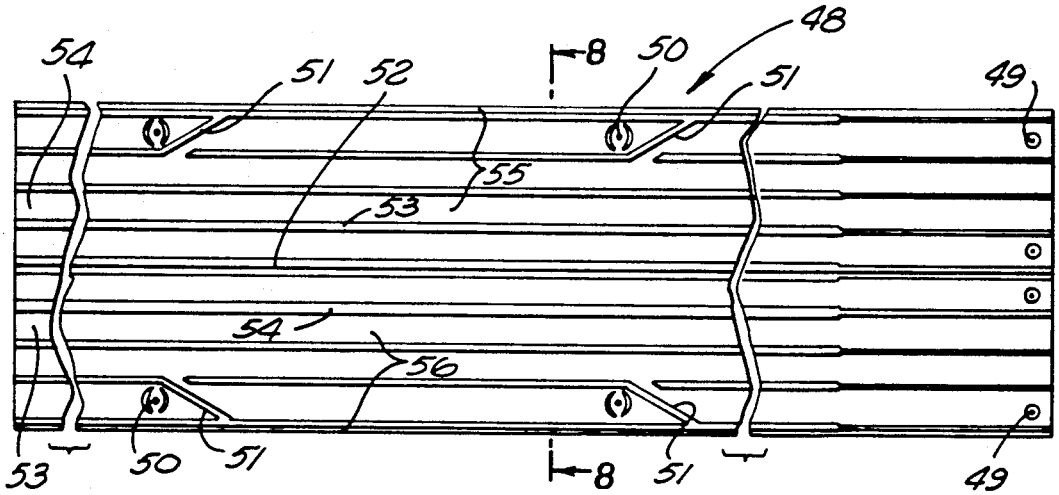
FIG. 7

ROOF VALLEY FLASHING INCLUDING EXPANSION JOINT

BACKGROUND OF THE INVENTION invention relates to a roof valley flashing and more particularly to a flashing formed of a unitary sheet of durable plastic material.

In a roof construction where two roof planes join at a valley, it has long been recognized that there are special problems in sealing to avoid leaks. The roof top environment is harsh and flashing structures placed in such valleys are expected to endure for many years despite exposure to intense sun, wind, rain, snow and ice, occasional walking on by roofers or other tradesmen, and temperature variations of as much as 100 degrees F. Sources of leaks through and around flashing include seams between metal pieces which open up due to temperature expansion causing failure of sealing material such as mastic; rusting of the flashing due to failure of the galvanized layer, in some cases because of electrolytic action around roofing nails; or build-up of ice in the valley causing water to be forced up under adjacent shingles or other roofing material. Certain sealing material simply becomes hard through aging in the environment and no longer retains the flexibility to provide effective seals.

Because of the above problems, the installation of such flashing structures in roof valleys typically requires the services of workmen having a substantial level of skill to avoid costly leaks.

There is, therefore, a need for a flashing structure to be installed in roof valleys which is sufficiently durable to withstand the above described environmental conditions, which is comparatively inexpensive, and which can be installed in a relatively short time by workmen having limited skill and experiences.

SUMMARY OF THE INVENTION

Applicant has provided a roof valley flashing of durable plastic material including an elongated panel having a flexure portion extending longitudinally through the center and a plurality of longitudinal ribs and, in one embodiment, interlocking ridges spaced from the flexure section on each side One embodiment utilizes a lateral fold between panels to permit the panels to be folded one on top of another for convenience in packaging and shipping. A second embodiment consists of individual panels of the same material having a modified cross section formed such that ends of the folds in the flexure section and the longitudinal ribs and interlocking ridges of adjacent panels overlap and nest together. This results in a series of overlapping panels with the upper panel always interlocking with and overlapping the one next below to avoid leakage. The longitudinal ribs extend to the side of the main fold or flexure a significant distance under the roofing material such that they direct water downwardly and prevent it or ice from moving laterally up under the roofing material. Special nailing areas are, or may be, formed into the panels to accommodate thermal expansion and contraction.

BRIEF DESCRIPTION OF THE DRAWINGS

FIG. 4 is a sectional view taken along line 4—4 of FIG. 3.

FIG. 5 is a fragmentary perspective view of another embodiment of my invention.

FIG. 6 is a partial sectional view taken along line 6—6 of FIG. 5.

FIG. 7 is a plan view of a further embodiment of my invention.

DESCRIPTION OF THE PREFERRED EMBODIMENTS

Figure 1:
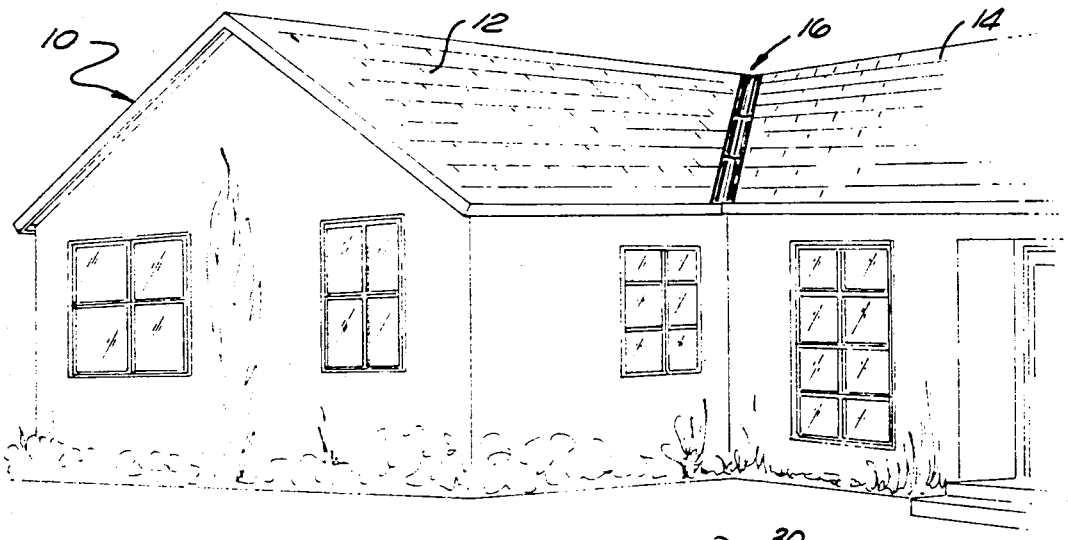
FIG. 1 is a partial perspective view of a house showing my roof valley structure installed between two roof planes.

Referring now to FIG. 1, a typical house is shown at numeral 10 having two roof planes 12,14 intersecting at a valley 16. Each of roof planes 12,14 are roofed with conventional roofing materials such as cedar or asphalt shingles. Located in the valley 16 is a roof flashing which folds at the valley and extends laterally a significant distance under the shingles or other roofing material such that it blocks any flow of water in the valley from flowing up under the roofing material and directs it downward toward a rain gutter or to the ground.

Figure 2:
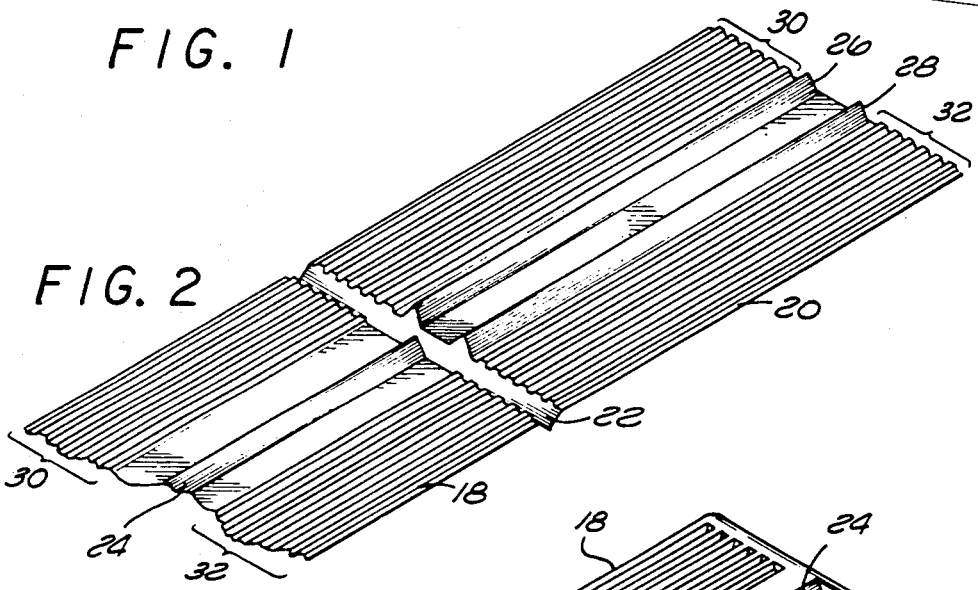
FIG. 2 is a fragmentary perspective view of one embodiment of my invention.

One embodiment of my roof valley flashing is shown in a fragmentary perspective view in FIG. 2. The roof valley flashing consists of one or more rectangular panels 18 of a durable polypropylene-synthetic rubber polymer with an ultraviolet stabilized pigment which may be of any desired length and which are joined with similar panels 20 by means of a horizontal fold 22. Each of panels 18 and 20 include a center flexure section which includes a single fold 24 on sheet 18 and double folds 26,28 on sheet 20. Both of panels 18 and 20 include, outboard of the flexure section, a series of longitudinal ribs 30,32 which are preferably molded such that the ribs of separate panels are in longitudinal alignment with each other. Depending upon the lengths of panels 18 and 20, there may be a number of such panels joined together by folds 22 in a given roof valley. When installed, the panels 18 and 20 are abutted together with each horizontal fold 22 folded upon itself and tucked under the upper of the two adjoining panels.

Figure 3:
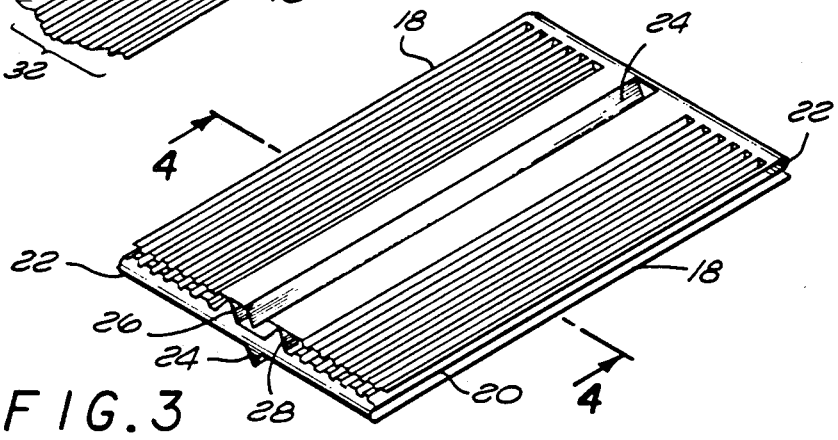
FIG. 3 is a perspective view of the embodiment of FIG. 2 with three sections shown folded together.

FIG. 3 shows three such panels 18, 20 folded upon each other as they might be for packaging and shipping. In this view a panel 18 with the single fold 24 is shown top and bottom with panel 20 in the center. One of folds 22 is visible at the front and anther toward the rear of the drawing. The manner in which these panels nest together when folded is shown on FIG. 4 which is a cross-sectional view taken along line 4—4 of FIG. 3. In this view it will be seen that the single fold 24 of panel 18 nests between folds 26 and 28 of panel 20.

FIG. 5 shows an alternate embodiment of my invention in which all of the panels 40 are identical, each including a center flexure portion having a single fold 42, laterally displaced interlocking ridges 43, 45 and two groups of parallel, longitudinally directed ribs 44,46.

FIG. 6 is a partial cross-sectional view taken through line 6—6 of FIG. 5. In this view it will be seen that panels 40 are laid together and in overlapping fashion such that the ridges 43,45 telescope and interlock together and ribs 44,46 of an upper panel will nest on corresponding ribs of the next lower panel. The folds 42 nest in a similar manner. If the panels 40 are nailed at the upper end all thermal expansion will take place below the nails and will result in a limited amount of sliding of the ends of folds 42, interlocking ridges 43,45 and ribs 44,46 over the corresponding parts of the lower sheet. With reasonable overlapping (6" to 9") no leakage will occur. The panels 40 are of the same material as described above and are vacuum formed with 9" to 12" on one end of the ribs 44,46, ridges 43,45 and folds 42 made slightly smaller so that the upper panel can overlap and interlock with the next lower panel in the roof valley.

FIG. 7 is a plan view of a modified form of the panel shown in FIG. 5 and 6. These panels 48 are typically ten feet long and will experience a significant thermal expansion. Nailing points are indicated at numeral 49 on the left end of the panel. Nail sections with expansion compensation devices 50 are shown on each outside edge of the panel spaced about one-third of the distance from each end. A sloped section 51 of a longitudinal rib is positioned above each nail section to divert any water away from the nail section toward the inside and down the slope. As shown, the right end of the panel 48 is the upstream end with water intended to flow from right to left. On approximately 9" to 12" of the right end, the fold 52, ridges 53,54 and the ribs 55,56 are made smaller to overlap and interlock with an adjacent panel.

Figure 8:
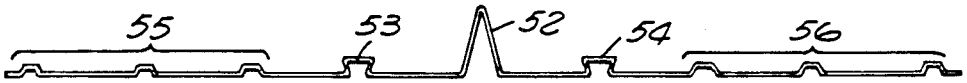
FIG. 8 is an enlarged sectional view taken along line 8—8 of FIG. 7.

FIG. 8 is a cross sectional view taken along line 8—8 of FIG. 7. It will be seen that this embodiment includes a single fold 52 in the flexure section, interlocking ridges 53,54 and longitudinal ribs 55,56.

Figure 11:
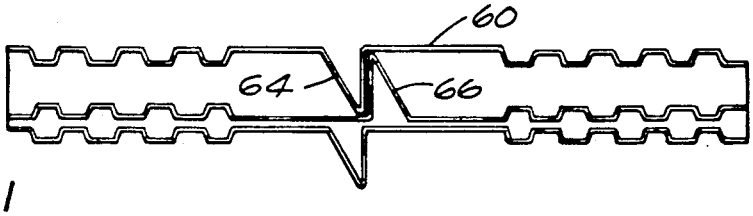
FIG. 11 is a cross sectional view taken along line 11—11 of FIG. 10.
Figure 9:
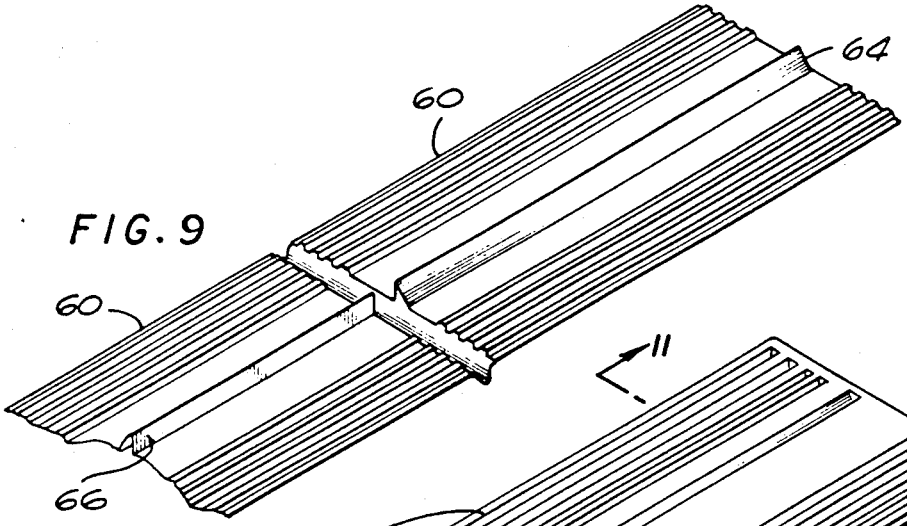
FIG. 9 is a fragmentary perspective view of still another embodiment of my invention.
Figure 10:
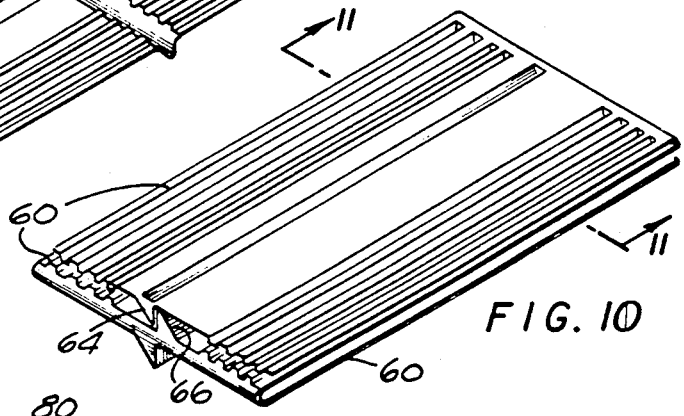
FIG. 10 is a perspective view of the embodiment of FIG. 9 with three sections folded together.
Figure 12:
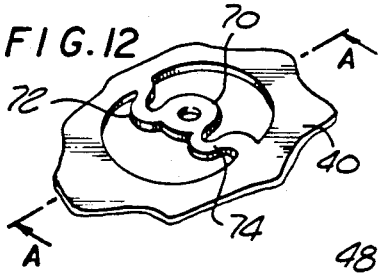
FIGS. 12, 12A, 13, and 14 are enlarged fragmentary perspective views of nailing sections usable with the embodiments of FIGS. 2-11.

FIG. 9 is a fragmentary perspective view of another embodiment of my invention in which the horizontal fold shown in FIG. 2 is incorporated with panels 60 which are very similar to panels 40 having a single fold in the flexure section but in which the folds 64,66 are slightly asymmetrical and slightly displaced with respect to those adjacent panels. FIG. 10 is a perspective view of three panels 60 folded together in the same manner as panels 18,20 were shown in FIG. 3. The manner in which panels 60,62 nest together is shown in FIG. 11, which is a cross sectional view taken along line 11—11 of FIG. 10. In this view it will be seen that folds 64,66 are slightly displaced and asymmetrical such that they rest side by side without interference.

FIG. 12,12A,14, and 16 depict various configuration of nailing sections which may be used with the above described embodiment. Each is designed to permit a small amount of displacement of the panel which it is a part without causing buckling or wrinkling of the panel. The version of FIG. 12 includes a center nailing part 70 which is connected to the edge of the panel 60, for example, means of sinuous strips 72,74. The areas on each side of strips 72 and 74 are cut out of the panel. This may be apparent from FIG. 12A which is a sectional view taken through line A—A of FIG. 12. The purpose of this cut out is to provide flexibility so that the panel 60 can expand or contract somewhat during temperature changes without causing buckling or distortion of the panel. The material used is a polypropylene-synthetic rubber polymer which can expand as much as one-half inch over ten feet. The nailing section shown in FIGS. 12 and 12A can take up a signification amount by distorting the sinuous members 72,74 rather than the panel itself. In the embodiments using separate panels, most of the expansion is taken up by the sliding of separate panels over each other, as described above.

Figure 13:
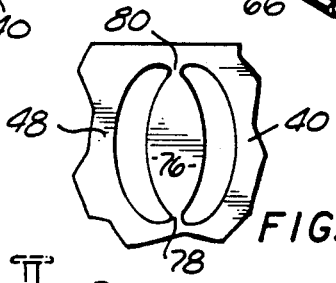
Figure 12A:
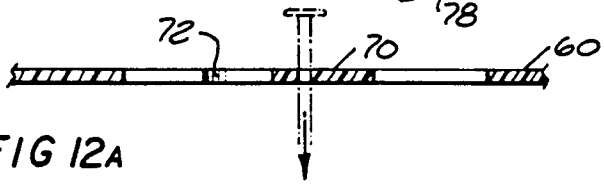
Figure 14:
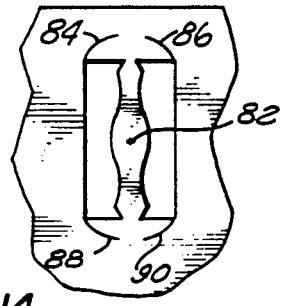

A somewhat different configuration of nailing section is shown in FIG. 13. In this section which may also be placed along edges of the panels 48 as shown in FIG. 7, a pair of quarter moon shaped cutouts positioned above and below a nailing pad 76 leaving the nailing pad 76 centered between the cutouts. The nailing pad has narrow arms 78,80 connecting it to the panel 40. Movement of the panel 48 will also cause distortion of the nailing pad 76 rather than the panel itself, thereby preventing buckling of the panel. FIG. 14 shows an additional nailing section 82 which also provides the function of generally holding the panel 60, for example, in place without distortion while the nailing section 82 takes up any travel in the panel by itself becoming distorted. This nailing section includes generally two rectangular cutouts above and below a nailing pad 82 which has narrowed ends attaching itself to the panel 60. Additional arcuate cuts 84, 86, 88, and 90 are made in the panel extending from the corners of the cut outs toward each other, leaving a weak strip between them. This nailing section distorts both at the narrow ends of the nailing pad 82 and also at the strips between the arcuate cuts 84 and 86 and between cuts 88 and 90 and is thus quite flexible in that it distributes the distorting forces over four weak connections, rather than two.

Any of the above described nailing sections may be used with any of the panels 18, 20, 40, 48 or 60. Since panels 18 and 20 and panels 60 are connected together in abutting fashion, they do not provide the overlapping and sliding capability afforded by individual panels 40. A series of such connected panels would panels would therefore tend to elongate or shorten with temperature changes over the length of a fifteen or twenty foot valley about the same as would a single panel of such length.

While only a limited number of embodiments have been disclosed herein it is recognized that modifications will be apparent to those skilled in the art and I do not desire to be limited except by the scope of the following claims as interpreted with the benefit of the doctrine of equivalents.

What is claimed is:

1. A roof valley flashing including a unitary strip of durable material adapted to be located in a junction between two plane surfaces of a roof, each said surface being covered with roofing material;

said strip comprising a rectangular panel of polypropylenesynthetic rubber having a flexure section extending longitudinally through its center and including laterally extending sides of such width that they can extend a substantial distance under said roofing material, each of said laterally extending sides including a plurality of longitudinally extending ribs spaced from and parallel to said flexure section; and means located on at least one end of said panel for engagement with another of said panels whereby a plurality of said panels may be arranged end to end as required by the length of said roof valley.

2. A roof valley structure as claimed in claim 1 wherein said engagement means comprises a laterally extending fold of said durable material connected to the ends of at least two of said panels.

3. A roof valley structure as claimed in claim 1 wherein said flexure section includes at least one longitudinal fold spaced from the said longitudinally extending ribs.

4. A roof valley structure as claimed in claim 2 wherein said flexure section includes at least one longitudinal fold spaced from said longitudinally extending ribs.

5. A roof valley structure as claimed in claim 2 wherein the flexure section on one of said two panels includes a single longitudinal fold spaced from said longitudinally extending ribs on both of said laterally extending sides and the flexure section of an adjacent panel includes a pair of spaced parallel longitudinal folds laterally displaced from said single fold whereby said panels can be folded together at said laterally extending fold with said single fold nesting between said pair of parallel longitudinal folds.

6. A roof valley structure as claimed in claim 5 wherein at least three of said panels are attached end to end by means of said laterally extending folds and the flexure section of said center panel includes a pair of parallel folds and the flexure sections of the two adjoining panels each include said single fold such that said panels can be folded together with one of said single folds nesting between said pair of parallel longitudinal folds and the fold of the third plastic sheet being supported on the longitudinal web between said folds of said center panel.

7. A roof valley structure as claimed in claim 1 wherein said engagement means comprises said longitudinally extending ribs which are open at their lower ends, such that said ribs are adapted to overlie and slide longitudinally relative to the longitudinally extending ribs of the other said panel.

8. A roof valley structure as claimed in claim 1 wherein said flexure section includes a fold extending the length of said panel; and said panel further including an interlocking ridge laterally displaced on each side of said fold between said fold and said longitudinally extending ribs, each said ridge being slightly narrower at one end of said panel such that a similar adjacent panel may overlie and interlock with said panel.

9. A roof valley structure as claimed in claim 8 wherein said engagement means comprises said fold, said longitudinally extending ribs and said interlocking ridges; said fold, said ribs and said ridges being open at one end and slightly smaller at the other end whereby one such panel can overlie and interlock with another.

10. A roof valley structure as claimed in claim 8 wherein said interlocking ridges includes two upstanding sides with a top approximately parallel to the plane of said panel and said sides slant opposite to the angles of said fold such that a length of said ridge of a first panel, carried in another such ridge of a second panel is captured and prevented from separation by lifting said second panel.

11. A roof valley structure as claimed in claim 8 wherein said panel includes nailing sections near its outer edges and diagonal rib members are included in said panels to divert water flowing toward said nailing sections into the channels between longitudinal ribs spaced inwardly of said nailing sections.

12. A roof valley structure as claimed in claim 1 wherein nailing sections are formed in said panels, said nailing sections each including a pad for receiving a nail, cut out portions extending generally longitudinally of said panel between opposite sides of said pad and the main body of said pad and a sinuous support portion extending generally laterally from both sides of said pad to the main body of said panel, such that upon expansion and contraction of said panel, said sinuous support portion may deform to permit longitudinal movement of said panel relative to said pad without buckling or bulging the main part of said panel.

13. A roof valley structure as claimed in claim 1 wherein nailing sections are formed in said panels, said nailing sections each including a pad for receiving a nail, cut out portions extending generally longitudinally of said panel between opposite sides of said pad and the main body of said panel and a support portion extending generally laterally from said pad to the main body of said panel, such that upon expansion and contraction of said panel, said support portion may deform to permit longitudinal movement of said sheet relative to said pad without buckling or bulging the main part of said panel.

14. A roof valley structure as claimed in claim 7 wherein nailing inserts are formed in said panels, said nailing inserts each including a pad for receiving a nail, generally rectangular cut out portions extending generally longitudinally of said panel between opposite sides of said pad and the main body of said panel, a support portion extending generally laterally from said pad to the main body of said panel, and cuts in said panel extending from corners of said cut out portion toward each other to provide weak points laterally of said pad such that upon expansion and contraction of said panel, said support portion and said weak parts of said panel between said cuts may deform to permit longitudinal movement of said panel relative to said pad without buckling or bulging the main part of said panel.

15. A roof valley structure as claimed in claim 13 wherein said panel includes nailing sections near its outer edges and diagonal rib members are included in said panels to divert water flowing toward said nailing sections into the channels between longitudinal ribs spaced inwardly of said nailing sections.

16. A roof valley structure as claimed in claim 9 wherein nailing sections are formed in said panels, said nailing sections each including a pad for receiving a nail, cut out portions extending generally longitudinally of said panel between opposite sides of said pad and the main body of said panel and a support portion extending generally laterally from said pad to the main body of said panel, such that upon expansion and contraction of said panel, said support portion may deform to permit longitudinal movement of said sheet relative to said pad without buckling or bulging the main part of said panel.

17. A roof valley flashing including a unitary strip of durable material adapted to be located in a junction between two plane surfaces of a roof, each said surface being covered with roofing material;

said strip comprising a rectangular panel of polypropylenesynthetic rubber having a flexure section including at least one longitudinal fold through its center and laterally extending sides of such width that they can extend a substantial distance under said roofing material, each of said laterally extending sides including a group of longitudinally extending ribs spaced from and parallel to said fold, and interlocking ridges extending longitudinally between said flexure section and said groups of ribs, each said interlocking ridge including two upstanding sides and a top surface generally parallel with the surface of said panel with said sides angled outwardly such that said top surface is wider than the base of said ridge;

each of said fold, said ridges and said longitudinally extending ribs being open at one end of said panel, and wherein a short section of said panel on the opposite end thereof is formed with at least said ridges slightly narrower than the ridges on the larger part of said panel.

* * * * *